US005611711A

United States Patent [19]

Okada et al.

[11] Patent Number: 5,611,711

[45] Date of Patent: Mar. 18, 1997

[54] ELECTRICAL CONNECTOR ASSEMBLY

[75] Inventors: Masao Okada; Kensaku Sato, both of Tokyo, Japan

[73] Assignee: Hirose Electric Co., Ltd., Tokyo, Japan

[21] Appl. No.: 512,758

[22] Filed: Aug. 9, 1995

[30] Foreign Application Priority Data

Sep. 9, 1994 [JP] Japan ..... 6-240856

[51] Int. Cl.[6] ..... H01R 13/648

[52] U.S. Cl. ..... 439/608

[58] Field of Search ..... 439/607, 609, 439/608, 701, 610

[56] References Cited

U.S. PATENT DOCUMENTS 5,167,531 12/1992 Broschard et al. ..... 439/607

5,171,161 12/1992 Kachlic ..... 439/607

*Primary Examiner*—Khiem Nguyen

*Assistant Examiner*—Yong Kim

*Attorney, Agent, or Firm*—Kanesaka & Takeuchi

[57] ABSTRACT

An electrical connector assembly consists of a first connector and a second connector. The first connector includes a first metallic housing and a first terminal unit comprising an insulating block, a first terminal supported by the insulating block, and a first shield jacket provided over the insulating block and the first terminal. The first terminal unit provided within the first metallic housing such that the first shield jacket is electrically connected to the first housing while the first terminal is connected to a printed circuit board. The second connector incudes a second housing of a synthetic resin and a second terminal unit comprising a second insulation block, a second terminal supported by the second insulation block, and a second shield jacket provided over the second insulation block and the second terminal; and the second terminal unit provided in the second housing.

10 Claims, 13 Drawing Sheets

ELECTRICAL CONNECTOR ASSEMBLY

BACKGROUND OF THE INVENTION

1. Field of the Invention

The present invention relates to electrical connector assembly for electronic equipment.

2. Description of the Related Art

FIG. 28 shows an electrical connector assembly consisting of a male connector 80 and a female connector 82. The male connector 80 includes a plurality of male terminals (not shown) provided within the male connector 80 for connection to electrical wires 81. The female connector 82 includes a plurality of female terminals (not shown) for connection to electrical wires 83. The male and female connectors 80 and 82 are mated to each other so as to bring the male terminals into contact with the female terminals while the lock 84 of the male connector 80 is engaged with the lock 85 of the female connector 82. A shielding member 86 covers both of the male and female connectors 80 and 82 and the electrical wires 81 and 83.

In the above connector assembly, it is necessary to wind a separate shield member 86 around both of the connectors and electric wires and it is difficult to provide a complete shielding.

SUMMARY OF THE INVENTION

Accordingly, it is an object of the invention to provide an electrical connector assembly capable of providing a complete shielding without the necessity of winding a separate shield member.

It is another object of the invention to provide an electrical connector which is able to provide a high shielding effect and a large mating tolerance and is easy to attach on the conductive case or the like.

According to the invention there is provided an electrical connector assembly comprising a first connector and a second connector. The first connector includes a first metallic housing and a first terminal unit comprising an insulating block, a first terminal supported by the insulating block, and a first shield jacket provided over the insulating block and the first terminal. The first terminal unit is provided within the first metallic housing such that the first shield jacket is electrically connected to the first housing while the first terminal is connected to a printed circuit board. The second connector includes a second housing of a synthetic resin; and a second terminal unit comprising a second insulation block, a second terminal supported by the second insulation block, and a second shield jacket provided over the second insulation block and the second terminal. The second terminal unit is provided in the second housing.

It is preferred that the first connector has a plurality of fitting recesses for a plurality of mating connectors and a plurality of terminal units.

It is also preferred that the second connector has a plurality of connector units for mating the respective fitting recesses of the first connector.

It is preferred that the second connector has an integrated section and a plurality of mating sections extending forwardly from the integrated section for mating the respective fitting recesses of the first connector.

It is also preferred that the second connector has a shield cover provided over an exposed portion of the shield jacket for the terminal unit.

Preferably, the connector assembly has a conductive case with a mounting mouth and a spring support attached to the mounting mouth for supporting of the mating section of the first connector thereby providing large mating tolerance.

Upon mating, the shields of a shielded cable is grounded to the case via the shield jacket of the second terminal unit, and the shield jacket and the housing of the first terminal unit.

The spring support not only absorbs attachment errors of the first connector but also enhances the shield effect of the connector, thereby facilitating attachment of the connector to the case or the like.

The above and other objects, features, and advantages of the invention will be more apparent when taken in conjunction with the accompanying drawings.

DESCRIPTION OF THE PREFERRED EMBODIMENT

Figure 1:
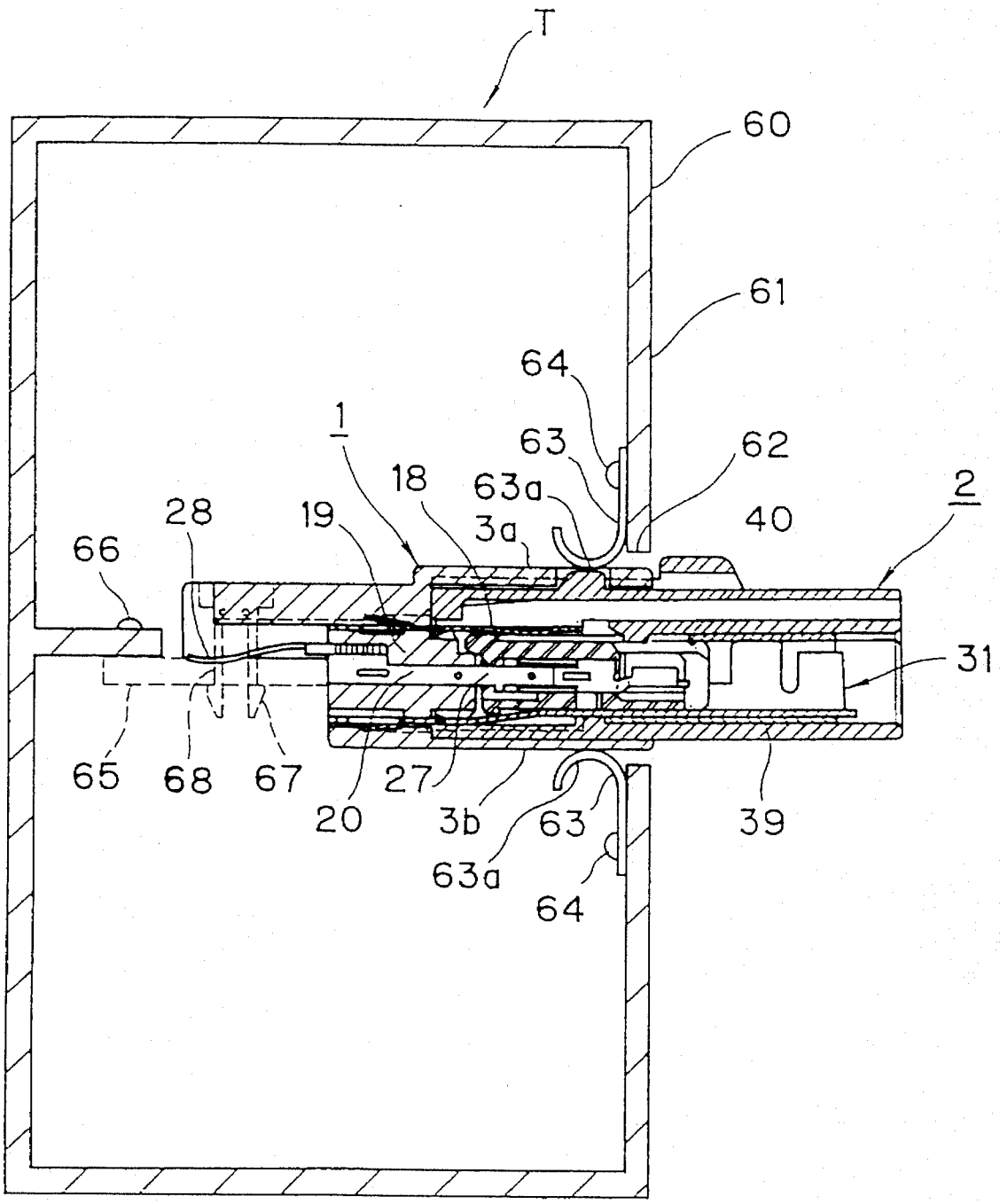
FIG. 1 is a longitudinal section of an electrical connector assembly according to an embodiment of the invention.

In FIGS. 1–5, an electrical connector assembly consists of a male connector 1 and a female connector 2. The male connector 1 includes a housing 3 and a male terminal unit 4. The housing 3 is made of metal by diecasting. Consequently, it has good electrical conductivity. A pair of fitting recesses 6 extends rearwardly from a front face of the housing 3. Circular sections 17L and 17R are provided on the upper left and right corners of the left and right fitting recesses 6L and 6R, respectively, to prevent wrong mating operations.

Figure 6:
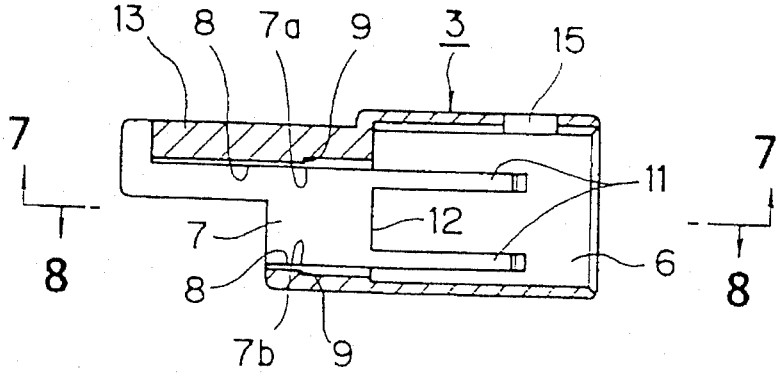
FIG. 6 is a longitudinal section of a female connector of the connector assembly.
Figure 7:
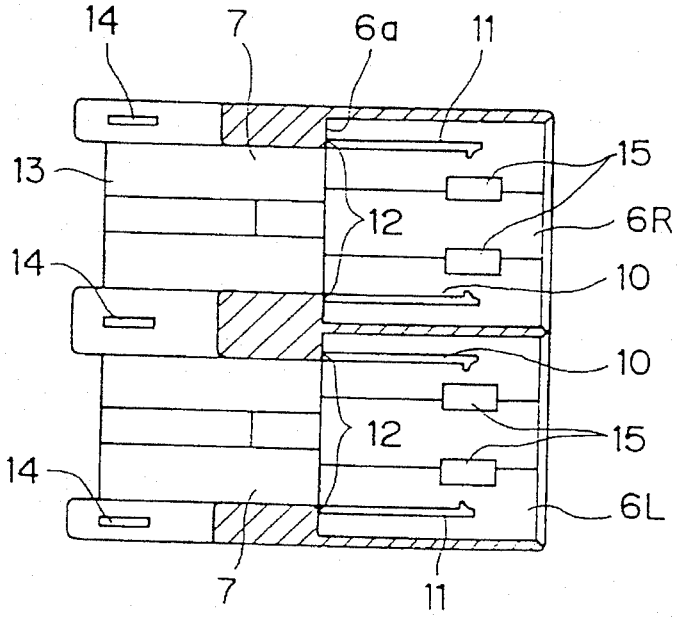
FIG. 7 is a sectional view taken along line 7—7 of FIG. 6.
Figure 8:
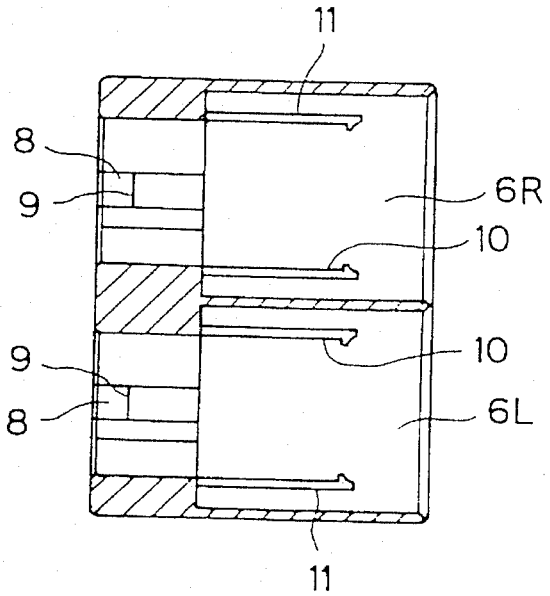
FIG. 8 is a sectional view taken along line 8—8 of FIG. 6.

In FIGS. 6–8, a rectangular opening 7 extend rearwardly from a rear wall 6*a* of the fitting recess 6 for receiving a terminal unit. A pair of lance grooves 8 extends along the longitudinal direction on the upper and lower faces 7*a* and 7*b* of the rectangular opening 7 for receiving lances. An engaging shoulder 9 is provided in a middle section of the lance groove 8. A pair of lances 10 and 11 extends forwardly from opposite sides of a front end of the rectangular opening 7.

The housing 3 has a rear extended section 13 which has lock pin apertures 14. Lock apertures 15 are provided in the upper wall of the fitting recess 6.

Figure 9:
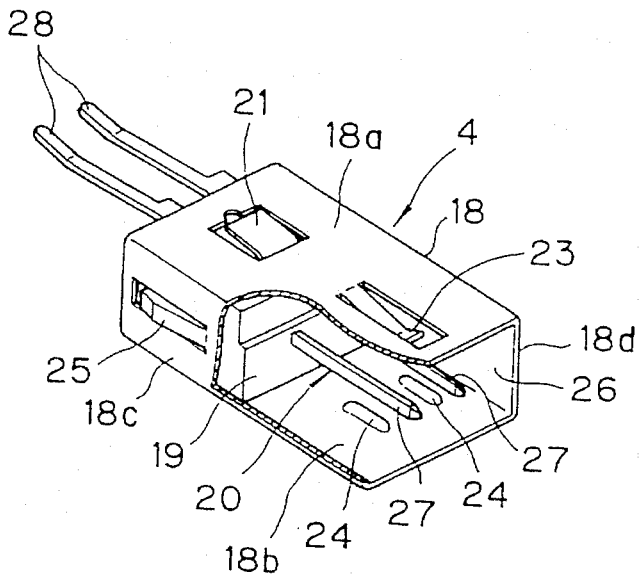
FIG. 9 is a perspective view of a male terminal unit of the male connector.
Figure 15:
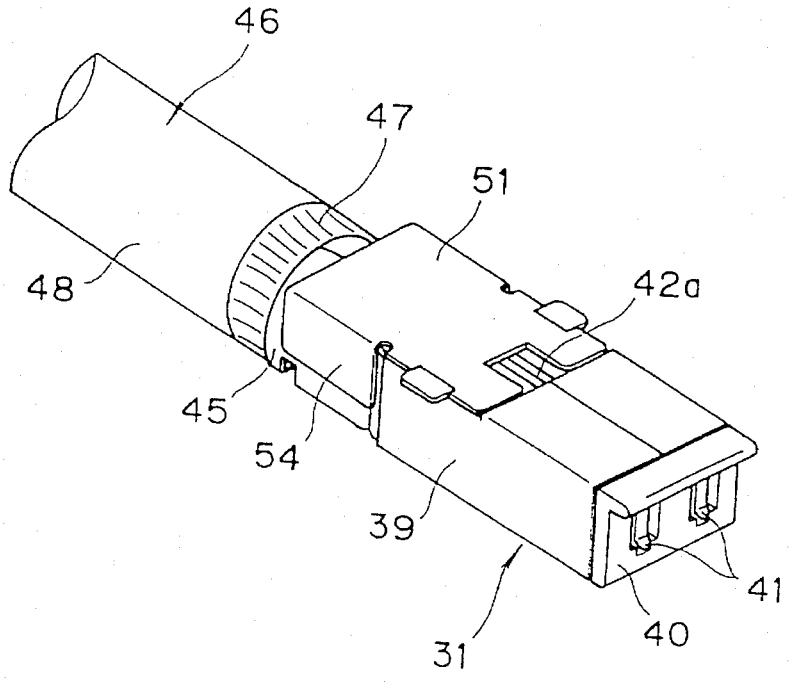
FIG. 15 is a perspective view of the female terminal unit under a shielding condition.

In FIG. 9, the male terminal unit 4 includes a shield jacket 18, an insulation block 19, and a male terminal 20. The shield jacket 18 is made by bending a metal (copper) plate into a rectangular cylindrical body. An upper lance 21 extends obliquely upwardly and rearwardly from the upper surface 18*a* of the shield jacket 18. Similarly, a lower lance is provided on the lower surface 18*b* of the shield jacket 18. A sliding finger 23 extends forwardly and inwardly from the upper surface 18*a*. A pair of sliding projections 24 are provided on the lower surface 18*b*. A pair of abutment fingers 25 extends obliquely upwardly and rearwardly from opposite side walls 18*c* and 18*d* of the shield jacket 18.

The shield jacket 18 protrudes forwardly from the insulation block 19 to form a fitting cavity 26. Contact portions 27 of the male terminal 20 project into the fitting cavity 26. The mounting portions 28 of the male terminal 20 project rearwardly from the insulation block 19.

The male terminal unit 4 is inserted into the rectangular opening 7 of the housing 3 such that the lances 21 of the shield jacket 18 engage the lance engaging shoulder 9 of the housing 3, forming the male connector 1.

Figure 10:
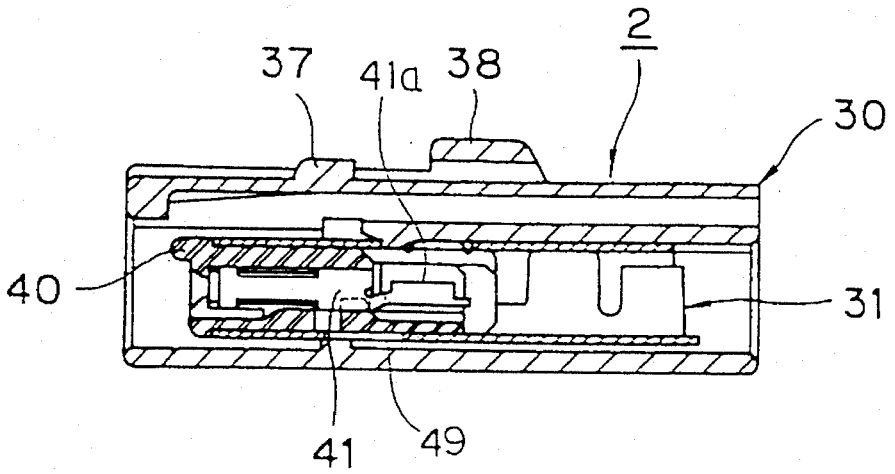
FIG. 10 is a longitudinal section of the female connector.

The female connector 2 consists of left and right female connector units 2L and 2R which fit in the left and right fitting recesses 6L and 6R of the male connector 1. As shown in FIG. 10, the left female connector unit 2L includes a housing 30 and a female terminal unit 31.

Figure 2:
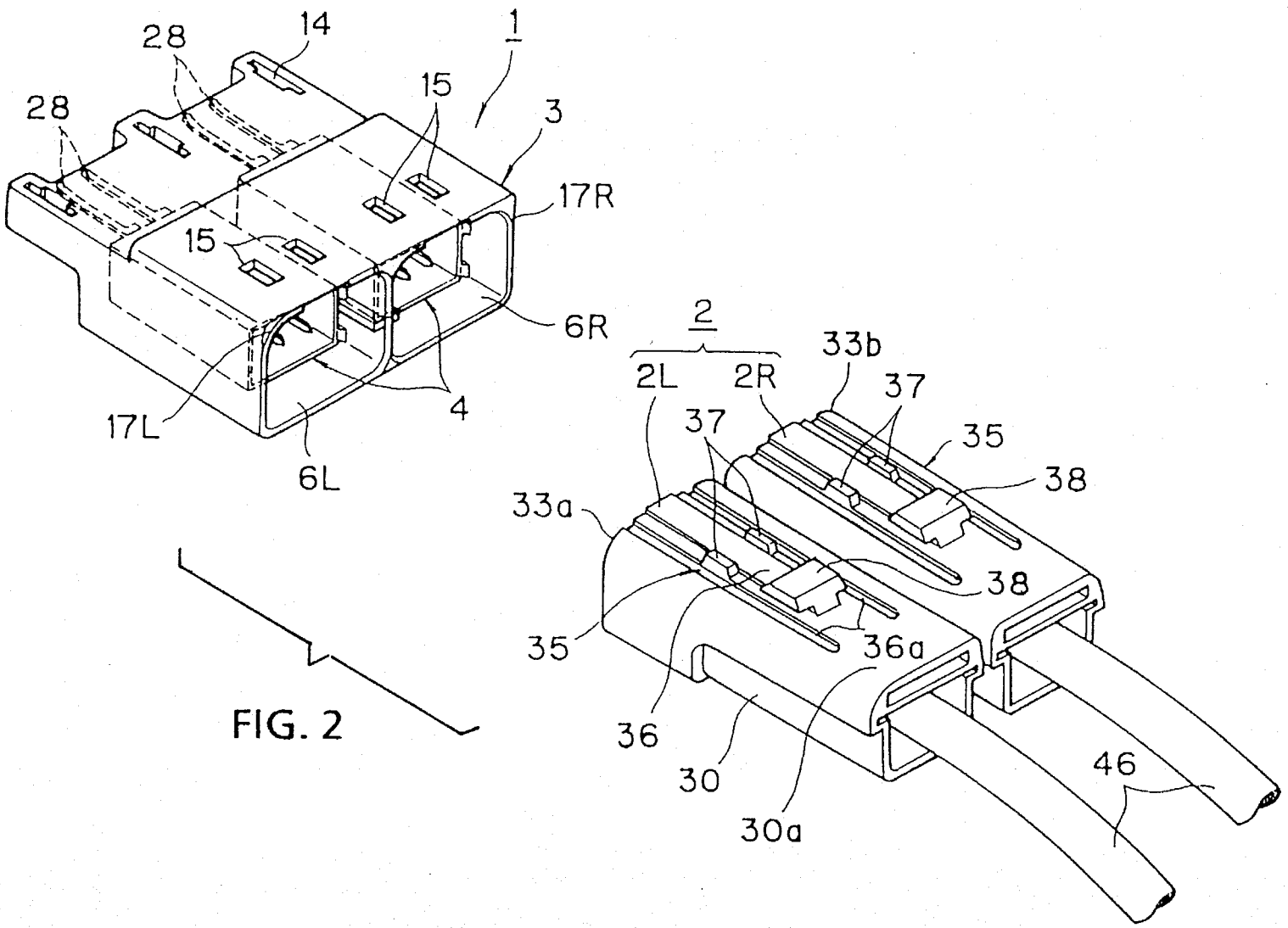
FIG. 2 is a perspective view of the electrical connector assembly.
Figure 3:
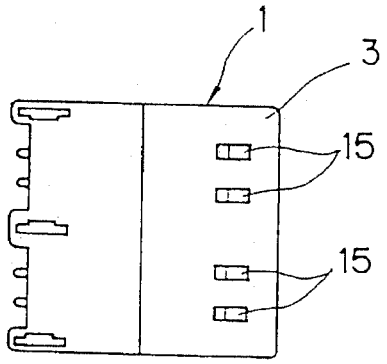
FIGS. 3–5 are top, side, and bottom views of a male connector of the connector assembly.
Figure 4:
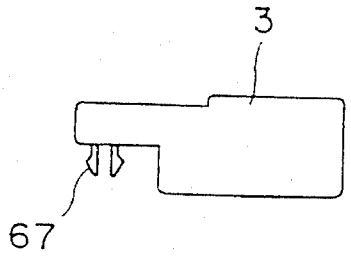
Figure 5:
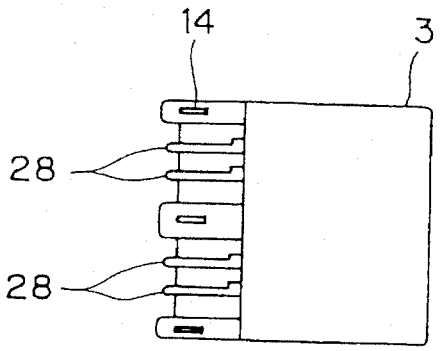
Figure 11:
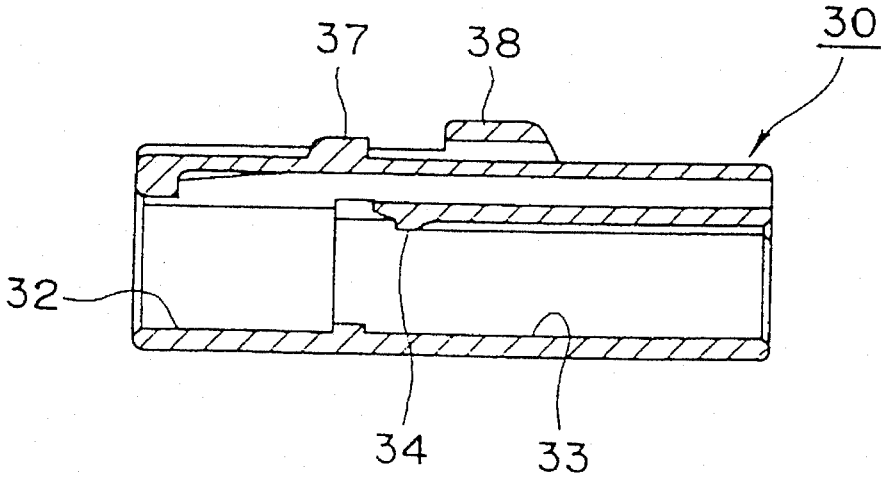
FIG. 11 is a longitudinal section of a housing of the female connector.
Figure 12:
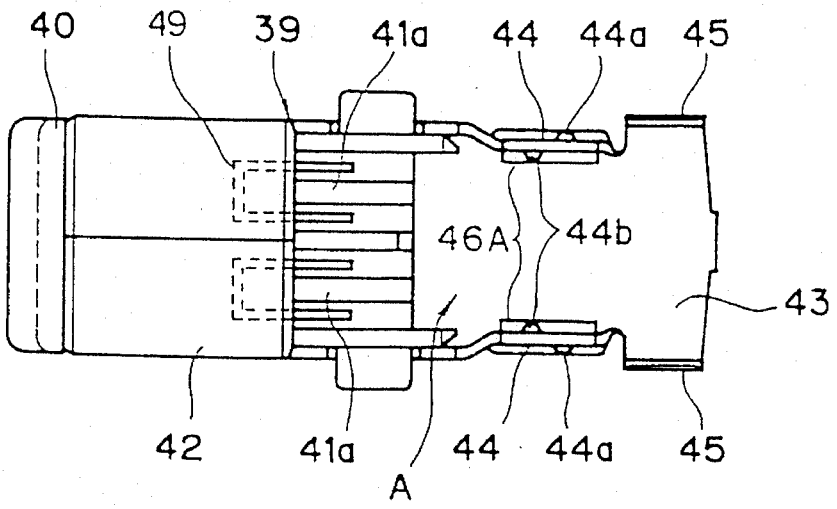
FIGS. 12–14 are top, side, and bottom views of a female terminal unit of the female connector.
Figure 13:
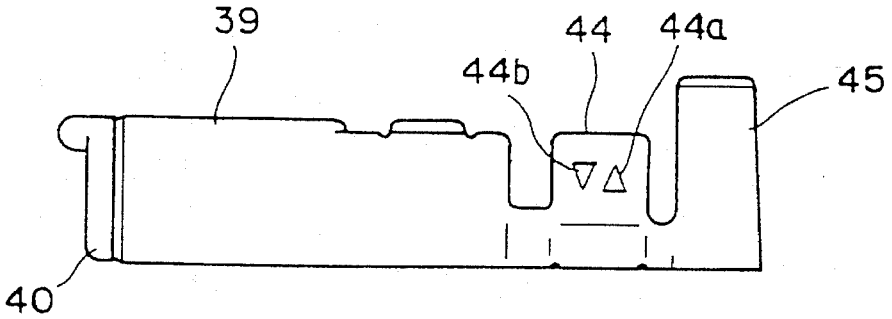
Figure 14:
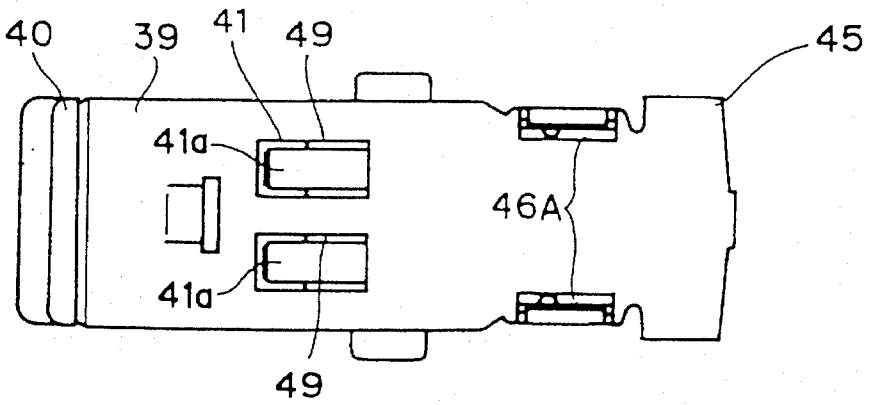
Figure 16:
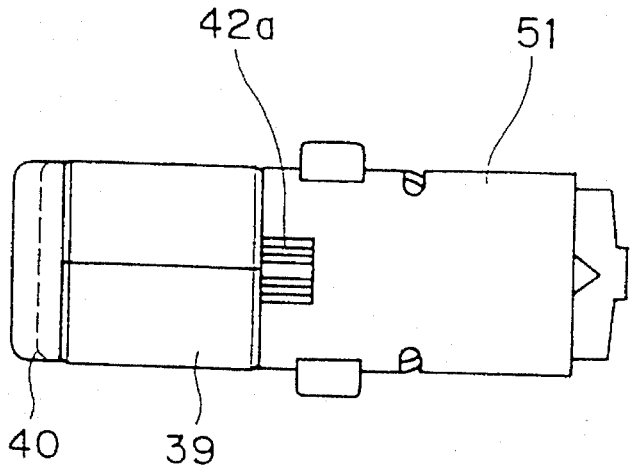
FIGS. 16–18 are top, side, and bottom views of the male terminal unit under a shielding condition.
Figure 17:
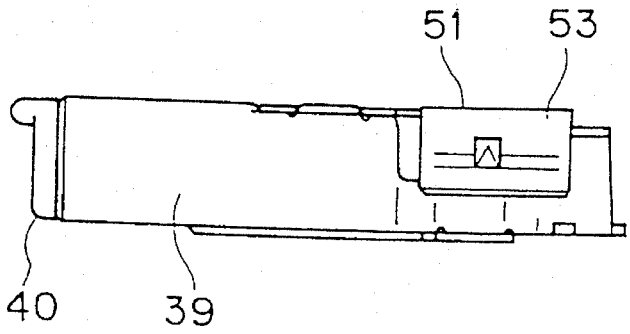
Figure 18:
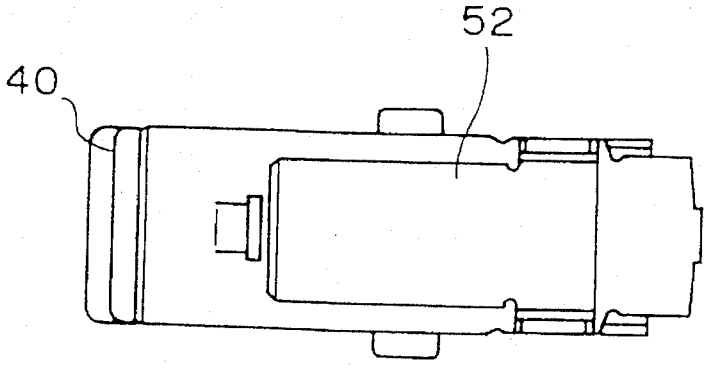

In FIG. 11, the housing 30 is made of synthetic resin in the form of a rectangular tube having a front mating section 32 and a rear terminal unit receiving section 33 with a lance projection 34 on the upper surface. As shown in FIG. 2, a circular portion 33*a* is provided on the upper left corner of the left connector unit 2L. A lock member 35 is provided on the upper wall 30*a* of the housing 30. The lock member 35 has a flexible arm 36 formed by a slit 36*a* in the upper wall 30*a*. The flexible arm 36 has a lock projection 37 and a release button 38.

In FIGS. 12–18, the female terminal unit 31 includes a shield jacket 39, an insulation block 40, and a female terminal 41. The shield jacket 39 has a shield tubular section 42 made by bending a metal (copper) plate into the form of a rectangular tube and a connection section 43 extending rearwardly from the shield tubular section 42. The connection section 43 has a pair of lock tabs 44 and a pair of crimping tabs 45. The lock tabs 44 have an outwardly projected lock claw 44a and an inwardly projected lock claw 44*b*. A pair of insertion slits 46A is provided at the base of the lock tabs 44.

The insulation block 40 with the female terminal 41 is fitted in the shield tubular section 42. The crimping portions 41*a* of the female terminal 41 projects to the connection section 43, and the crimping tabs 41*a* are crimped on core wires of a shielded cable 46. The crimping tabs 45 are crimped on the shields 47 of the shielded cable 46.

A cover member 51 covers the exposed portion of the core wires of the shielded cable 46 connected to the terminal unit 31, and a cover member 52 covers openings 49 for signal terminal engaging lances on the bottom of the terminal unit 31, thus making the shield complete.

Figure 19:
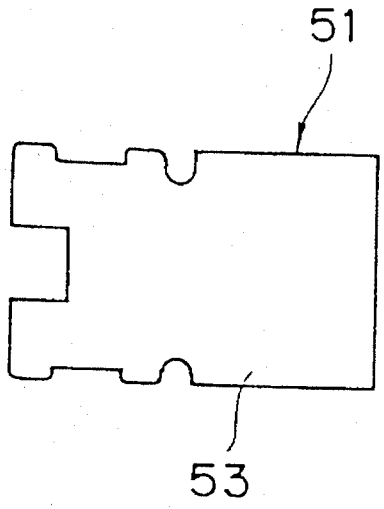
FIGS. 19–21 are top, side, and rear views of an upper shielding cover.
Figure 20:
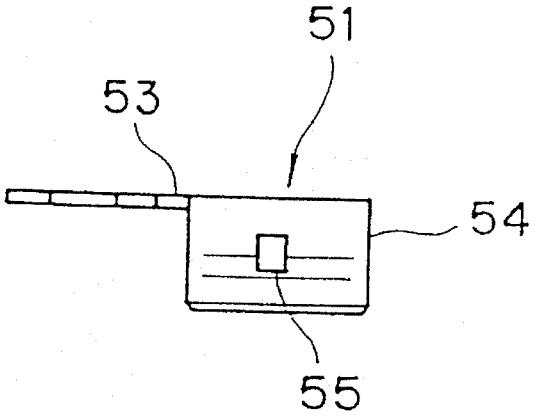
Figure 21:
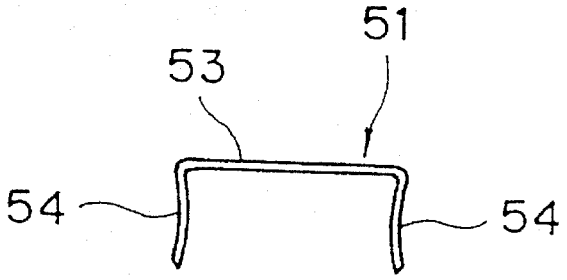

In FIGS. 19–21, the shield member 51 has a shield section 53 and a pair of leg sections 54 extending downwardly from a rear portion of the shield section 53 and having a lock aperture 55. The shield member 51 is mounted on the terminal unit 31 by engaging the lock apertures 55 with the lock claws 44*a* of the lock tabs 44 so that the shield member 51 covers the exposed portion of the core wires.

Figure 22:
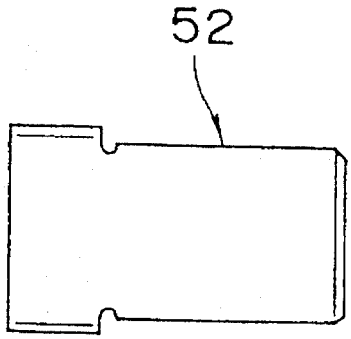
FIGS. 22–24 are top, side, and rear views of a lower shielding cover.
Figure 23:
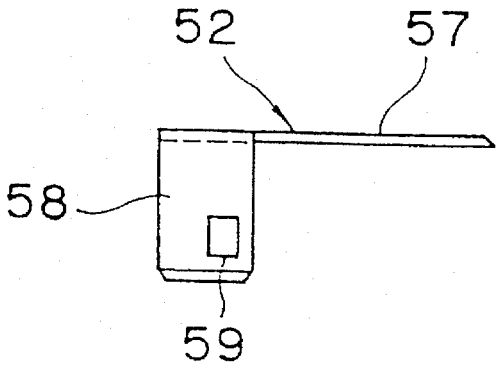
Figure 24:
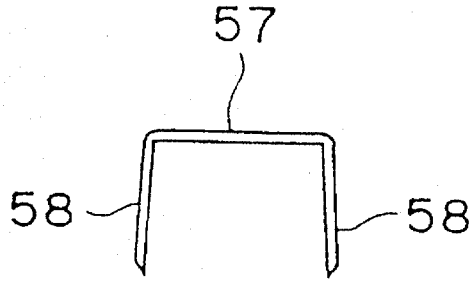

In FIGS. 22–24, the other shield cover 52 has a shield section 57 and a pair of leg sections 58 extending upwardly from a rear portion of the shield section 57 and having a lock aperture 59. By inserting the leg sections 54 into the slits 46A of the shield jacket 39 and engaging the lock apertures 55 with the lock claws 44*b* of the lock tabs 44, the shield member 51 is attached to the shield jacket 39 so that it covers the openings 49.

The terminal units 31 are inserted into the fitting recesses 32 of the housing 30 so that the lance projection 34 of the housing 30 engages the rear edge 42*a* of the shield jacket 42 to form the female connector 2.

As shown in FIG. 2, the right female connector unit 2R is identical with the left female connector unit 2L except that a circular portion 33*b* is provided on the upper right corner of the right connector unit 2R. That is, the circular portions 33*a* and 33*b* of the left and right female connector units 2L and 2R correspond to the circular portions 17L and 17R of the fitting recesses 6L and 6R of the male connector 1, respectively, to prevent wrong plugging operations.

As shown in FIG. 1, the male connector 1 is mounted on a controller T for example. A mounting mouth 62 is provided on a front panel 61 of a metal case 60. A pair of J-shaped leaf springs 63 are attached by fasteners 64 to the upper and lower sides of the mounting mouth 62. The rear portion of a printed circuit board 65 is attached by fasteners 66 to the rear panel of the case 60.

The mounting section 28 of the male terminal 20 is soldered to the conductor of the PCB 65 such that the lock pins 67 fitted in the lock pin aperture 14 are inserted into and engaged with the pin aperture 68 of the PCB 65. The male connector 1 is supported by the upper and lower leaf springs 63, with the upper and lower surfaces 3*a* and 3*b* abutted against the curved portions 63*a* of the upper and lower leaf springs 63, so that the front portion of the male connector 1 protrudes from the mounting mouth 62.

The housing 3 of the female connector 1 is made of metal and is conductive. Consequently, the shield jacket 18 of the terminal unit 4 is electrically connected to the case 60 or grounded through the housing 3, the leaf springs 63 and the fasteners 64.

How to mate the male and female connectors 1 and 2 will be described below.

The female connector 2 is mated to the male connector 1 which is mounted on the case 60 as described above. The front portions of the housings 33 of the female connector 2 are inserted into the fitting recesses 6L and 6R of the housing 3 of the male connector 1 so that the shield jackets 39 of the female terminal units 31 are fitted into the fitting recesses 26 of the shield jackets 18 of the male connector 1 to insert the contact portions 27 of the male terminal 20 into the contact portions of the female terminal 41 while the lock projections 37 of the female connector 2 are engaged with the lock apertures 15 of the male connector 1.

The shields 47 of the shielded cable 46 are grounded to the case 60 via the shield jacket 39 of the female terminal unit 31, the shield jacket 18 of the male terminal unit 4, the housing 3, the leaf springs 63, and the fasteners 64.

To remove the female connector units 2L and 2R from the male connector 1, the release button 38 of the female connector units 2L or 2R is depressed to deflect the flexible arm 36 thereby releasing the lock projects 37 from the lock apertures 15 of the male connector 1 so that the female connector units 2L or 2R is pulled out.

Figure 25:
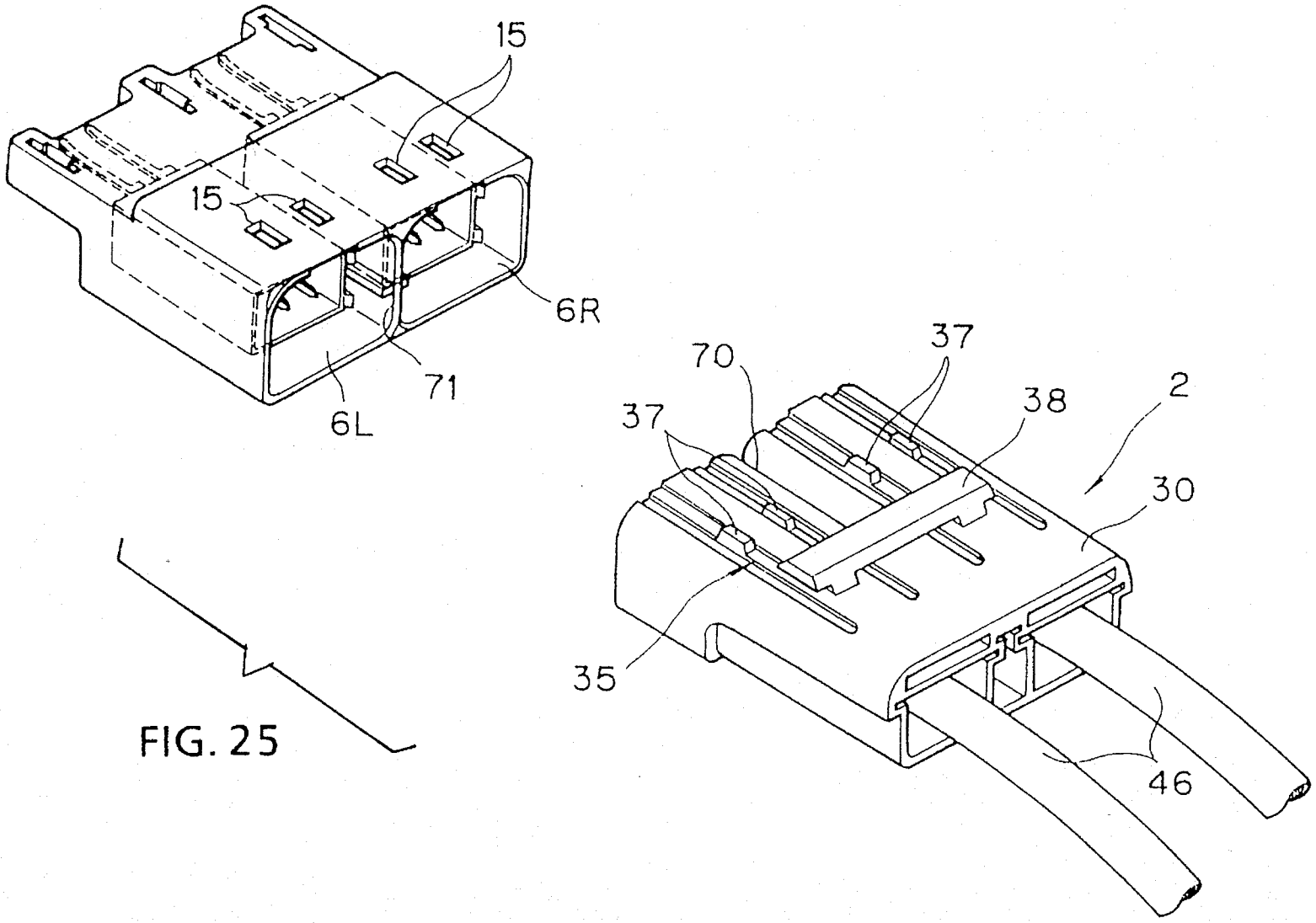
FIG. 25 is an electrical connector assembly before connection according to another embodiment of the invention.
Figure 26:
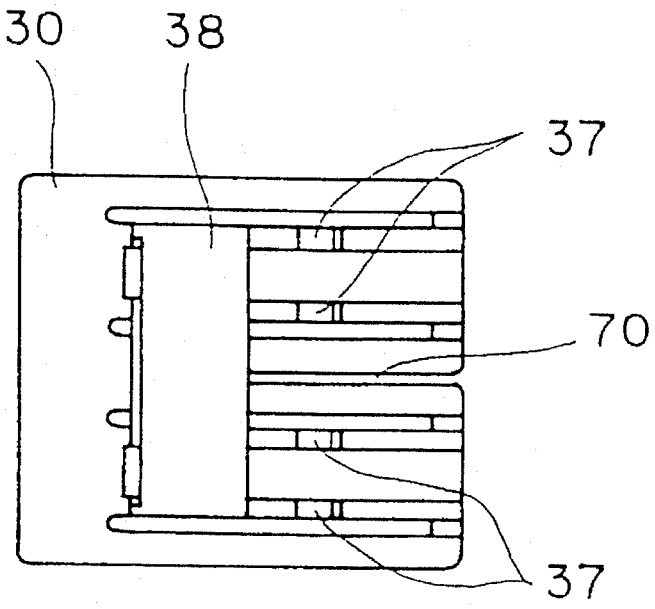
FIG. 26 is a top plan view of a housing of a female connector for the connector assembly of FIG. 25.
Figure 27:
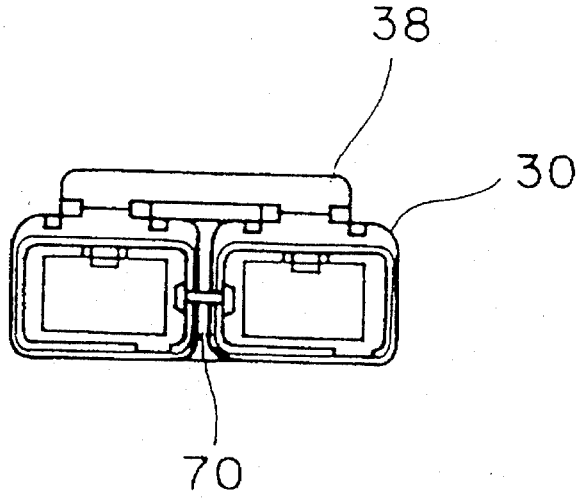
FIG. 27 is a front elevational view of the housing.
Figure 28:
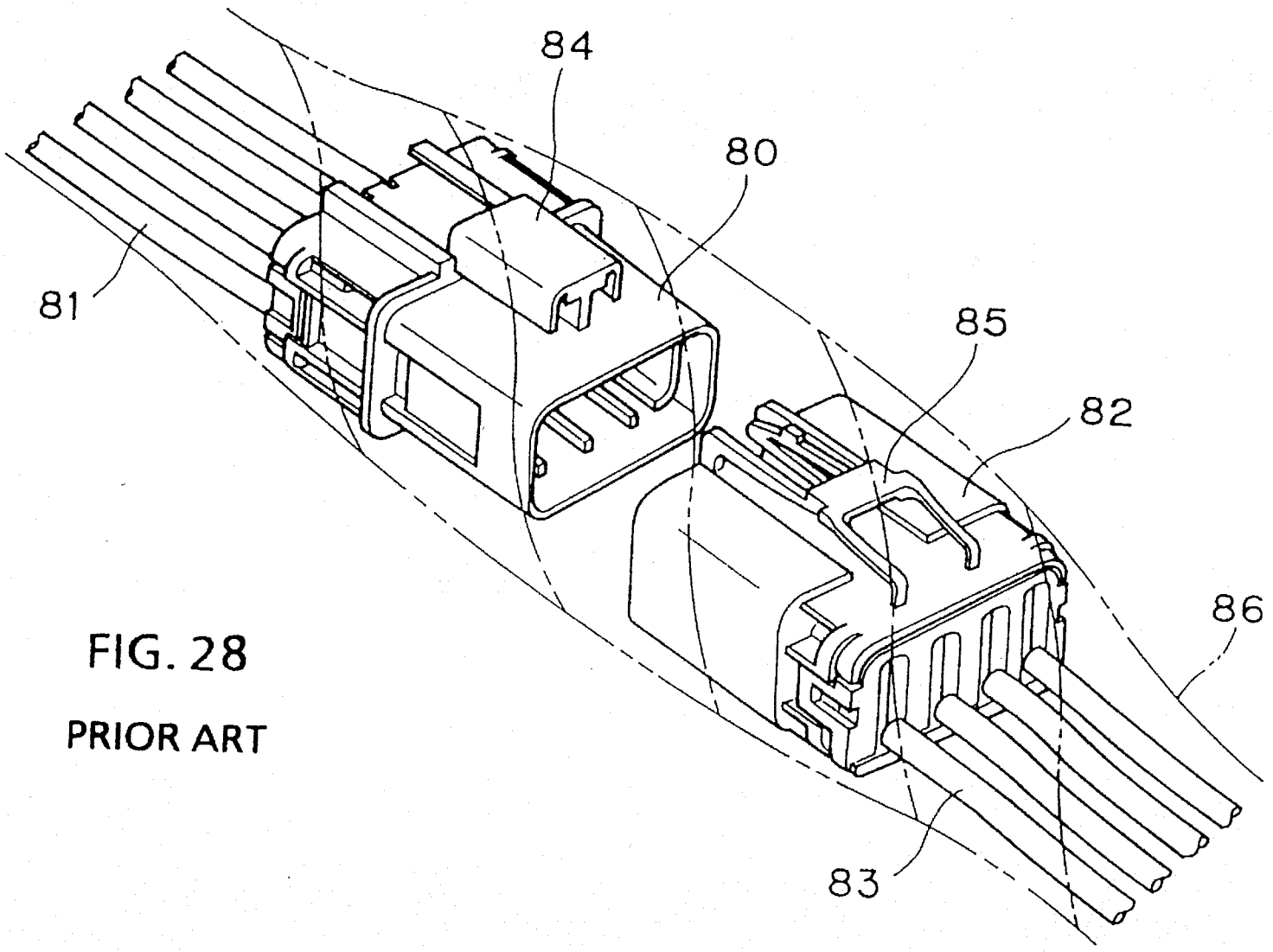
FIG. 28 PRIOR ART
FIG. 28 is a conventional electrical connector assembly.

In FIG. 25, the left and right female connector units 2L and 2R are integrated in this alternative embodiment. The housing 30 is integrated in the rear section but separated by a cut 70 in the middle of the front section. Only one integrated release button 38 is provided on the upper surface of the housing 30.

When the female connector 2 is inserted into the fitting recesses 6L and 6R of the male connector 1, the partition 71 between the fitting recesses 6L and 6R enters the cut 70.

The shield jacket 39 of the female terminal unit 31 is fitted into the fitting section 26 of the shield jacket 18 of the male connector 1 so that the contact portions of the female terminal 41 are brought into contact with the contact portions 27 of the male terminals 20 while the lock projects 37 of the female connector 2 are engaged with the lock apertures 15 of the male connector 1 for lock.

The shields 47 of the shielded cable 46 are grounded to the case 60 via the shield jacket 39 of the female terminal unit 31, the shield jacket 18 of the male terminal unit 4, the housing 3, the leaf springs 63, and the fasteners 64.

To remove the female connector 2L and 2R from the male connector 1, the release button 38 of the female connector units 2L and 2R is depressed to deflect the flexible arm 36 so that the lock projects 37 are released from the lock apertures 15 of the male connector 1 thereby permitting the female connector 2 to be pulled out.

As has been described above, according to the invention, upon connection, the shields of a shielded cable is grounded to the case via the shield jacket of its own, and the shield jacket of a terminal unit and the housing of the mating connector. Thus, a complete shield is provided without using a separate shield member which, in turn, eliminates the winding operation of shield material.

A conductive spring member is provided at a mounting mouth of a case to support the fitting recesses of a connector so that not only the spring member absorbs the mounting errors of the connector but also the shield effect is enhanced, facilitating the mounting of the connector on the conductive case or the like.

The metal cover covers the exposed portion of the shield in the mating connector to enhance the shield effects.

We claim:

1. An electrical connector assembly comprising a first connector and a second connector;

said first connector comprising:

a first metallic housing;

a first terminal unit comprising an insulating block, a first terminal supported by said insulating block, and a first shield jacket provided over said insulating block and said first terminal;

said first terminal unit provided within said first metallic housing such that said first shield jacket is electrically connected to said first housing; and said second connector comprising:

a second housing of a synthetic resin; and a second terminal unit comprising a second insulation block, a second terminal supported by said second insulation block, and a second shield jacket provided over said second insulation block and said second terminal; and said second terminal unit provided in said second housing, wherein said second terminal unit comprises a metallic shield cover provided over an exposed portion of said second shield jacket.

2. An electrical connector assembly according to claim 1, wherein said first connector comprises a plurality of fitting recesses for receiving a plurality of mating units of said second connector and a plurality of terminal units provided adjacent to said fitting recesses for contact with said mating units.

3. An electrical connector assembly according to claim 2, wherein said second connector comprises a plurality of connector units to be fitted into said respective fitting recesses of said first connector.

4. An electrical connector assembly according to claim 2, wherein said second connector comprises an integrated section and a plurality of mating sections extending forwardly from said integrated section for mating said respective fitting recesses.

5. An electrical connector assembly according to claim 1, wherein said second terminal unit comprises a metallic shield cover provided over an exposed portion of said second shield jacket.

6. An electrical connector assembly comprising a first connector and a second connector;

said first connector comprising:

a first metallic housing;

a first terminal unit comprising an insulating block, a first terminal supported by said insulating block, and a first shield jacket provided over said insulating block and said first terminal;

said first terminal unit provided within said first metallic housing such that said first shield jacket is electrically connected to said first housing; and said second connector comprising:

a second housing of a synthetic resin; and a second terminal unit comprising a second insulation block, a second terminal supported by said second insulation block, and a second shield jacket provided over said second terminal unit provided in said second housing, which further comprises an electrically conductive case with a mounting mouth and spring means provided at said mounting mouth for supporting a mating portion of said first connector.

7. An electrical connector assembly according to claim 6, wherein said first connector comprises a plurality of fitting recesses for receiving a plurality of mating units of said second connector and a plurality of terminal units provided adjacent to said fitting recesses for contact with said mating units.

8. An electrical connector assembly according to claim 7, wherein said second connector comprises a plurality of connector units to be fitted into said respective fitting recesses of said first connector.

9. An electrical connector assembly according to claim 7, wherein said second connector comprises an integrated section and a plurality of mating sections extending forwardly from said integrated section for mating said respective fitting recesses.

10. An electrical connector assembly according to claim 6, wherein said second terminal unit comprises a metallic shield cover provided over an exposed portion of said second shield jacket.

* * * * *